US010493757B2

(12) United States Patent
White et al.

(10) Patent No.: US 10,493,757 B2
(45) Date of Patent: Dec. 3, 2019

(54) INK JET PRINTHEAD

(71) Applicant: HEWLETT-PACKARD DEVELOPMENT COMPANY, L.P., Houston, TX (US)

(72) Inventors: Lawrence H White, Corvallis, OR (US); Melinda M Valencia, Corvallis, OR (US); Michael Hager, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/521,287

(22) PCT Filed: Oct. 30, 2014

(86) PCT No.: PCT/US2014/063185

§ 371 (c)(1),
(2) Date: Apr. 22, 2017

(87) PCT Pub. No.: WO2016/068947

PCT Pub. Date: May 6, 2016

(65) Prior Publication Data

US 2017/0305170 A1 Oct. 26, 2017

(51) Int. Cl.
*B41J 2/14* (2006.01)
*B41J 2/175* (2006.01)
(Continued)

(52) U.S. Cl.
CPC ..... *B41J 2/14* (2013.01); *B41J 2/04595* (2013.01); *B41J 2/1404* (2013.01); *B41J 2/1433* (2013.01);
(Continued)

(58) Field of Classification Search
CPC ..... B41J 2/14; B41J 2/14427; B41J 2/14129; B41J 2/04595; B41J 2/2125; B41J 2/2146;
(Continued)

(56) References Cited

U.S. PATENT DOCUMENTS 5,208,605 A 5/1993 Drake
5,412,410 A 5/1995 Rezanka
(Continued)

FOREIGN PATENT DOCUMENTS

CN 1278485 1/2001
CN 1453131 11/2003
(Continued)

*Primary Examiner* — Sharon A. Polk
(74) *Attorney, Agent, or Firm* — HP Inc. Patent Department

(57) ABSTRACT

Printheads and methods for forming printheads are described herein. In one example, a printhead includes a number of drop generators, wherein a pitch between each adjacent drop generator is substantially the same, and the drop generators alternate between a high drop weight (HDW) drop generator and a low drop weight (LDW) drop generator. The printhead also includes a flow channel from an ink source leading into an ejection chamber associated with each drop generator, wherein the flow channel comprises an inflow region proximate to the ink source, wherein an area of the inflow region is adjusted to control the flux of ink into the ejection chamber.

20 Claims, 10 Drawing Sheets

500

(51) Int. Cl.
*B41J 2/21* (2006.01)
*B41J 2/045* (2006.01)

(52) U.S. Cl.
CPC ..... *B41J 2/14129* (2013.01); *B41J 2/14427* (2013.01); *B41J 2/175* (2013.01); *B41J 2/2125* (2013.01); *B41J 2/2146* (2013.01); *B41J 2202/11* (2013.01)

(58) Field of Classification Search
CPC ..... B41J 2/1433; B41J 2/1404; B41J 2/175; B41J 2202/11
See application file for complete search history.

(56) References Cited

U.S. PATENT DOCUMENTS

| | | | | |
|---|---|---|---|---|
| 5,519,423 | A * | 5/1996 | Moritz, III | B41J 2/1404 347/65 |
| 6,284,436 | B1 | 9/2001 | Ahn et al. | |
| 6,959,979 | B2 | 11/2005 | Goin et al. | |
| 7,404,626 | B2 | 7/2008 | Piatt et al. | |
| 7,909,428 | B2 | 3/2011 | Donaldson et al. | |
| 8,338,195 | B2 | 12/2012 | Sasaki et al. | |
| 8,870,337 | B1 * | 10/2014 | Jensen | B41J 2/01 347/19 |
| 2002/0135640 | A1 | 9/2002 | Chen et al. | |
| 2002/0158945 | A1 | 10/2002 | Miller et al. | |
| 2003/0103105 | A1 | 6/2003 | Kawamura | |
| 2008/0266369 | A1 * | 10/2008 | Petersen | B41J 2/17513 347/87 |
| 2011/0310182 | A1 | 12/2011 | Mardjlovjch et al. | |
| 2013/0155137 | A1 * | 6/2013 | Mantell | B41J 2/2128 347/15 |
| 2014/0036002 | A1 | 2/2014 | Delametter et al. | |

FOREIGN PATENT DOCUMENTS

| | | |
|---|---|---|
| CN | 102333656 | 1/2012 |
| EP | 1275505 | 1/2003 |
| JP | 2013-311964 | 11/2003 |
| JP | 2005-008652 | 1/2005 |
| JP | 2005-153435 | 6/2005 |
| JP | 2005-161595 | 6/2005 |
| JP | 2009-040035 | 2/2009 |
| JP | 2009-143228 | 7/2009 |
| JP | 2009-248517 | 10/2009 |
| JP | 2011-525437 | 9/2011 |
| WO | WO-2005035255 | 4/2005 |
| WO | WO-2014/007814 | 1/2014 |

* cited by examiner

100

200

400

500

600

(Prior Art)

700

700

800

900

1000

INK JET PRINTHEAD

BACKGROUND

Thermal ink jet printheads are fabricated on integrated circuit wafers. Drive electronics and control features are first fabricated, then the columns of heater resistors are added and finally the structural layers, for example, formed from photoimageable epoxy, are added, and processed to form the drop generators. The structural layers are used to make the flow channels that route ink from the supply to the ejection chambers, to make the sidewalls of the drop generators, and to fabricate the nozzles. Typically, three layers of epoxy are used. The epoxy layers include a thin primer layer to assure good adhesion, a layer for construction of flow channels and ejection chambers, and a final layer that seals the channels and provides nozzles for drop ejection.

BRIEF DESCRIPTION OF THE DRAWINGS

Certain examples are described in the following detailed description and in reference to the drawings, in which.

DETAILED DESCRIPTION OF SPECIFIC EXAMPLES

Figure 1:
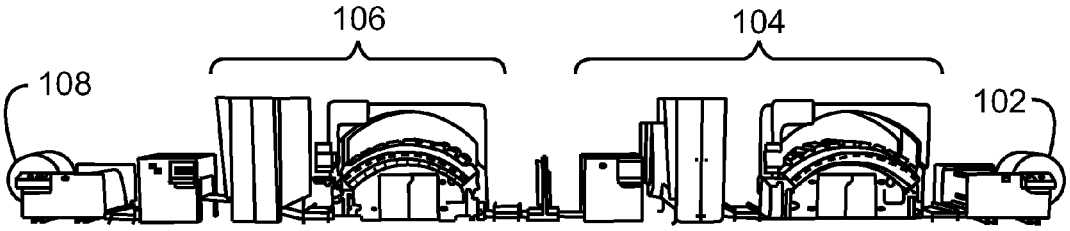
FIG. 1 is a drawing of an example printing press that uses ink jet printheads to form images on a print medium.

Ink jet printheads can be designed to produce two drop sizes, termed interstitial dual drop weight (iDDW), for example, by alternating the widths of drop generators, including the heater resistors and nozzles. As used herein, a drop generator is an apparatus that ejects an ink drop at a print medium. The drop generator includes an inflow region comprising a flow chamber that fluidically couples an ink source with an ejection chamber. The ejection chamber has a heating resistor on a surface, and a nozzle disposed proximate the heating resistor. When a firing pulse is applied to the heating resistor, a steam or solvent bubble is formed within the ejection chamber, which forces an ink drop out the nozzle.

Each printhead has multiple columns of drop generators that alternate between high drop weight (HDW) and low drop weight (LDW). The HDW may be in the range of about 6-11 nanograms (ng), or about 9 ng, while the LDW maybe in the range of about 3-5 ng, or about 4 ng. The drop generators share the same stack thickness for the fluidic, or ink flow, channels, and are centered on substantially the same pitch to assure correct drop placement, e.g., 21.2 micrometers (μm) for 1200 dots per inch (dpi).

However, the HDW and LDW drop generators have different functional requirements. For example, the HDW drop generator will need to refill at a higher rate than the LDW drop generator to maintain printing speed. Further, back pressure from the bubble formation in the LDW drop generator may force a portion of the ink back into fluid channels rather than out the nozzle, decreasing the momentum of the ejected drop. Accordingly, if the same inflow design is used for both drop weights, either the refill of the HDW drop generator or the momentum of drops from the LDW drop generator may be compromised.

Techniques for forming printheads that balance the requirements for the HDW and LDW drop generators are described herein. In the techniques, the centerlines of the alternating drop generators remain on the desired pitch, for example, every 21.2 um, but the area of the fluid channels are independently adjusted for each size of drop generator.

In one example, a portion of the space in the Y direction, e.g., between adjacent drop generators, that would normally provide the inflow for the LDW is used for the HDW. This provides faster refill for the HDW without limiting refill for the LDW. The inflow width for the HDW can be increased by up to about 5 μm or over 25% with this technique. The refill rate may increase proportionally. This design may also increase the momentum of the LDW drops, e.g., a narrower flow channel may decrease backflow.

In another example, improved refill of the HDW drop generator is obtained by changing one of the three layers, e.g., the epoxy layers, which are used to construct flow channels and nozzles. Typical printhead designs use a first layer, termed a primer layer, to improve adhesion to the substrate, a second layer to define the flow channels, and a third layer to cap the flow channels and form nozzles for ejecting the drops. In this technique the primer layer can be adjusted to alter the height, and thus, the cross-sectional area of the inlet channels for the two drop generators. As the HDW drop generator has a higher flow requirement, primer material may be removed from the inflow region in order to increase the cross-sectional area and increase flow. In contrast, the LDW drop generator generally needs less than half of the flow of the HDW drop generator, but may use additional drop momentum. Thus, additional primer material can be used in the inflow region of the LDW drop generator. This design may provide faster refill for the HDW without limiting refill for the LDW. Removing primer from the HDW inflow region may increase the refill of the HDW drop generator by about 3 kilohertz (kHz).

FIG. 1 is a drawing of an example of a printing press 100 that uses ink jet printheads to form images on a print medium. The printing press 100 can feed a continuous sheet of paper from a large roll 102. The paper can be fed through a number of printing systems, such as printing systems 104 and 106. In the first printing system 104 a printbar that houses a number of printheads ejects ink drops onto the paper. A second printing system 106 may be used to print additional colors. For example, the first system 104 may print black, while the second system 106 may print cyan, magenta, and yellow (CMY). The printing systems 104 and 106 are not limited to two, or the mentioned color combinations, as any number of systems may be used, depending, for example, on the colors desired and the speed of the printing press 100.

After the second system 106, the printed paper may be taken up on a take-up roll 108 for later processing. In some examples, other units may replace the take-up roll 108, such as a sheet cutter and binder, among others. The printing press 100 may have a very high speed of operation and printing, and, thus, the design of the printheads may be important to achieving this speed. In the example shown, the paper, or other print medium, may be moving at about 800 feet per minute, or about 244 meters per minute, or faster. Further, the printing press 100 may print about 129 million letter-sized images per month.

Figure 2:
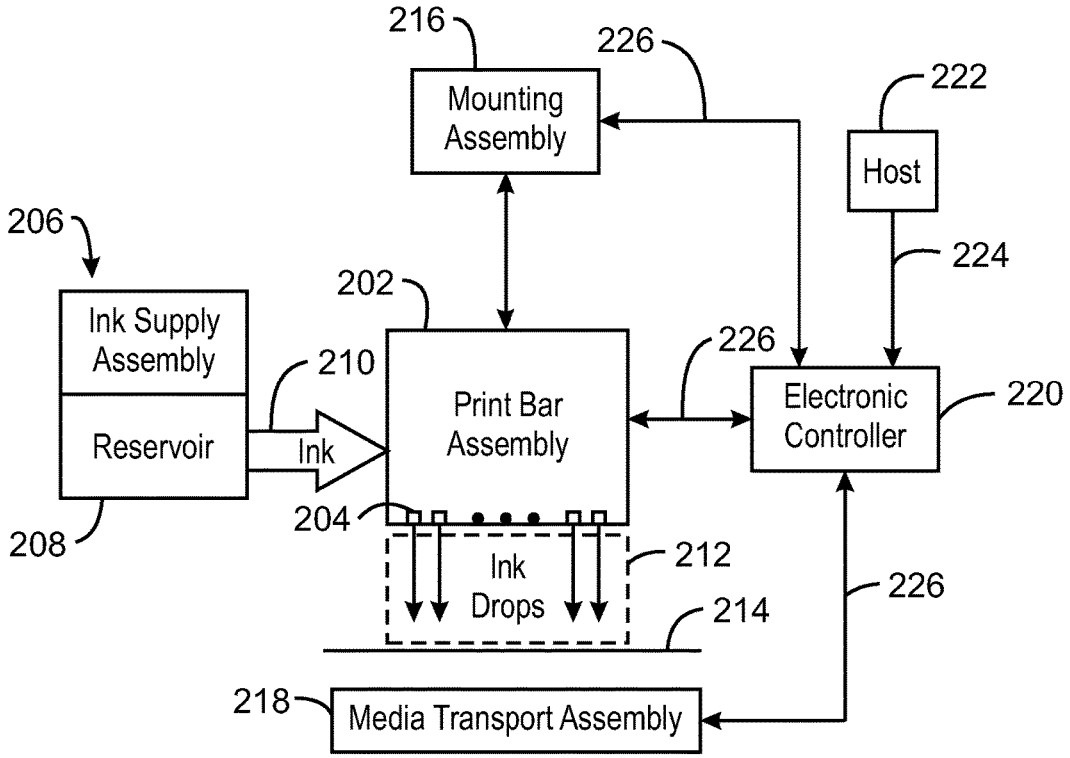
FIG. 2 is a block diagram of an example of an ink jet printing system that may be used to form images using ink jet printheads.

FIG. 2 is a block diagram of an example of an ink jet printing system 200 that may be used to form images using ink jet printheads. The ink jet printing system 200 includes a printbar 202, which includes a number of printheads 204, and an ink supply assembly 206. The ink supply assembly 206 includes an ink reservoir 208. From the ink reservoir 208, ink 210 is provided to the printbar 202 to be fed to the printheads 204. The ink supply assembly 206 and printbar 202 may use a one-way ink delivery system or a recirculating ink delivery system. In a one-way ink delivery system, substantially all of the ink supplied to the printbar 202 is consumed during printing. In a recirculating ink delivery system, a portion of the ink 210 supplied to the printbar 202 is consumed during printing, and another portion of the ink is returned to ink supply assembly. In an example, the ink supply assembly 206 is separate from the printbar 202, and supplies the ink 210 to the printbar 202 through a tubular connection, such as a supply tube (not shown). In other examples, the printbar 202 may include the ink supply assembly 206, and ink reservoir 208, along with a printhead 202, for example, in single user printers. In either example, the ink reservoir 208 of the ink supply assembly 206 may be removed and replaced, or refilled.

From the printheads 204 the ink 210 is ejected from nozzles as ink drops 212 towards a print medium 214, such as paper, Mylar, cardstock, and the like. The print medium 214 may be pretreated to improve print quality, for example, with a clear pretreatment. This may be performed in the printing system. The nozzles of the printheads 204 are arranged in one or more columns or arrays such that properly sequenced ejection of ink 210 can form characters, symbols, graphics, or other images to be printed on the print medium 214 as the printbar 202 and print medium 214 are moved relative to each other. The ink 210 is not limited to colored liquids used to form visible images on paper. For example, the ink 210 may be an electro-active substance used to print circuits and other items, such as solar cells. In some examples, the ink 210 may include a magnetic ink.

Further, in examples described herein, the printheads 204 have an iDDW design. In the iDDW design, one of two different sized ink drops 212 may be ejected from the printheads 204 depending on the types of images to be printed. However, it is desirable for the ink jet printing system 200 to maintain a high printing speed, and, thus, the printheads 204 may be designed to provide a similar speed for printing using each drop size.

A mounting assembly 216 may be used to position the printbar 202 relative to the print medium 214. In an example, the mounting assembly 216 may be in a fixed position, holding a number of printheads 204 above the print medium 214. In another example, the mounting assembly 216 may include a motor that moves the printbar 202 back and forth across the print medium 214, for example, if the printbar 202 only included one to four printheads 204. A media transport assembly 218 moves the print medium 214 relative to the printbar 202, for example, moving the print medium 214 perpendicular to the printbar 202. In the example of FIG. 1, the media transport assembly 218 may include the rolls 102 and 108, as well as any number of motorized pinch rolls used to pull the paper through the printing systems 104 and 106. If the printbar 202 is moved, the media transport assembly 218 may index the print medium 214 to new positions. In examples in which the printbar 202 is not moved, the motion of the print medium 214 may be continuous.

A controller 220 receives data from a host system 222, such as a computer. The data may be transmitted over a network connection 224, which may be an electrical connection, an optical fiber connection, or a wireless connection, among others. The data 220 may include a document or file to be printed, or may include more elemental items, such as a color plane of a document or a rasterized document. The controller 220 may temporarily store the data in a local memory for analysis. The analysis may include determining timing control for the ejection of ink drops from the printheads 204, as well as the motion of the print medium 202 and any motion of the printbar 202. The controller 220 may operate the individual parts of the printing system over control lines 226. Accordingly, the controller 220 defines a pattern of ejected ink drops 212 which form characters, symbols, graphics, or other images on the print medium 214. For example, the controller 220 may determine when to use HDW and LDW drops for printing a particular image.

The ink jet printing system 200 is not limited to the items shown in FIG. 2. For example, the controller 220 may be a cluster computing system coupled in a network that has separate computing controls for individual parts of the system. For example, a separate controller may be associated with each of the mounting assembly 216, the printbar 202, the ink supply assembly 206, and the media transport assembly 218. In this example, the control lines 226 may be network connections coupling the separate controllers into a single network. In other examples, the mounting assembly 216 may not be a separate item from the printbar 202, for example, if the printbar 202 is fixed in place.

Figure 3:
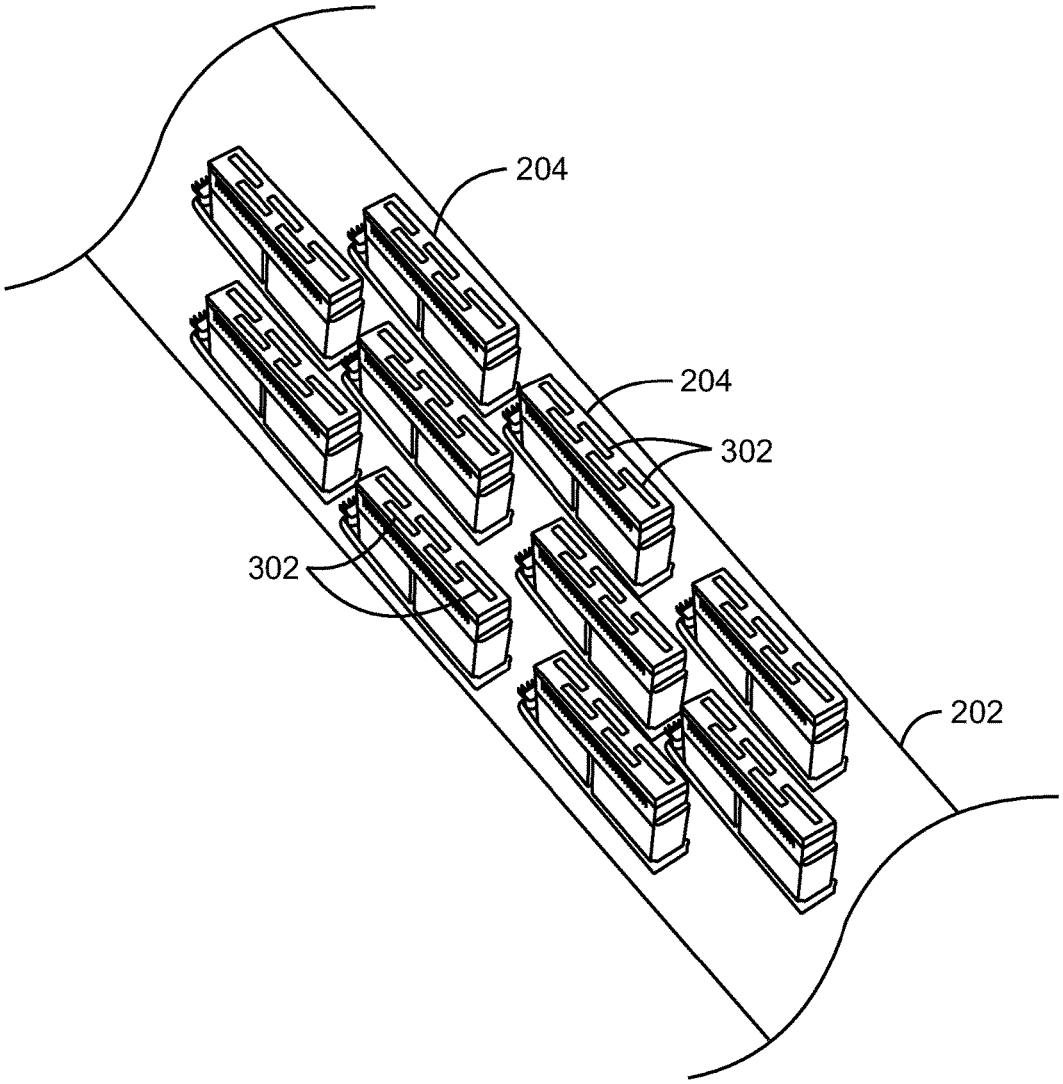
FIG. 3 is a drawing of a cluster of ink jet printheads in an example print configuration, for example, in a printbar.

FIG. 3 is a drawing of a cluster of ink jet printheads 204 in an example print configuration, for example, in a printbar 202. Like numbered items are as described with respect to FIG. 2. The printbar 202 shown in FIG. 3 may be used in configurations that do not move the printhead. Accordingly, the printheads 204 may be attached to the printbar 202 in an overlapping configuration to give complete coverage. Each printhead 204 has multiple nozzle regions 302, such as columns of nozzles that alternate HDW drop generators and LDW drop generators.

Figure 4:
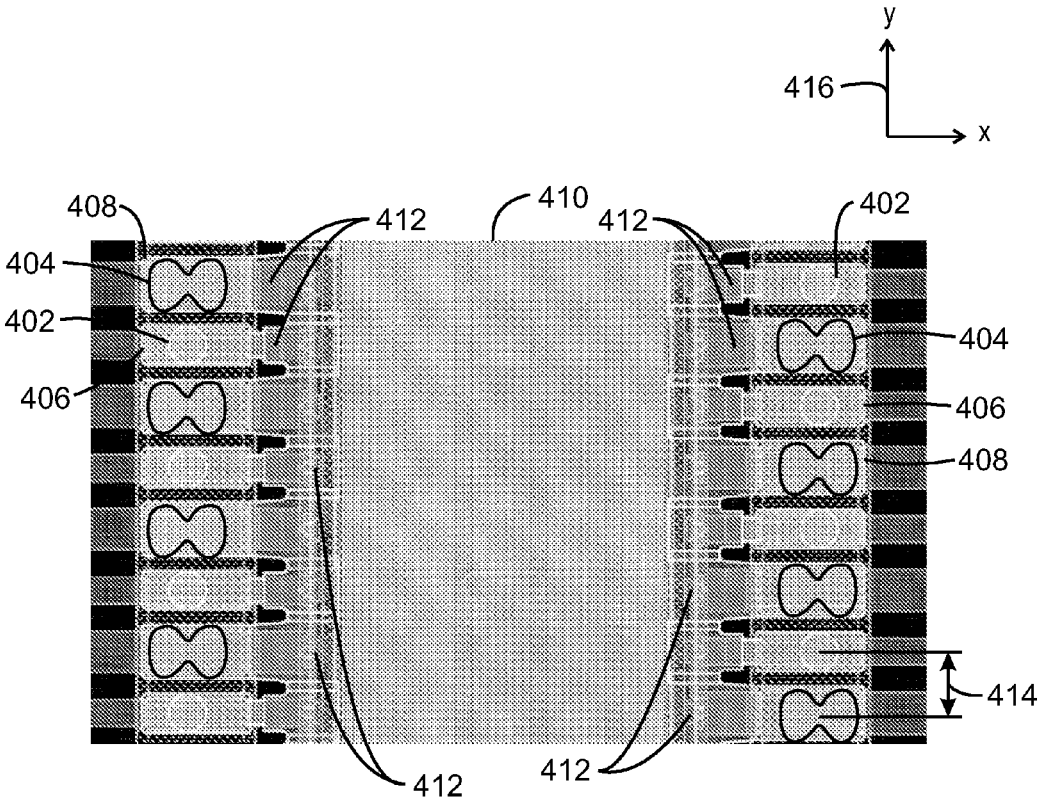
FIG. 4 is a top view of an example printhead showing adjacent nozzles over resistors.

FIG. 4 is a top view of an example printhead 400 showing adjacent nozzles 402 and 404 over resistors 406 and 408, respectively. A smaller nozzle 402 is located over a narrower resistor 406 to provide the LDW drop, for example, about 4 nanograms (ng) in weight. A larger nozzle 404 is located over a wider resistor 408 to provide the HDW drop, for example, about 9 ng in weight. An ink refill region 410 is coupled to each nozzle 402 and 404 through an inflow region 412 (to simplify the drawing, only a portion of the inflow regions are labeled). The resistor pitch 414 may constant, for example, at 21.1 um in the y-direction 416 in order to assure correct drop placement. A HDW drop generator includes a larger nozzle 404, a wider resistor 408, an ejection chamber located proximate to the nozzle and resistor, and an associated inflow region 412. A LDW drop generator includes a smaller nozzle 402, a narrower resistor 406, an ejection chamber located proximate to the nozzle and resistor, and an associated inflow region 412.

Figure 5:
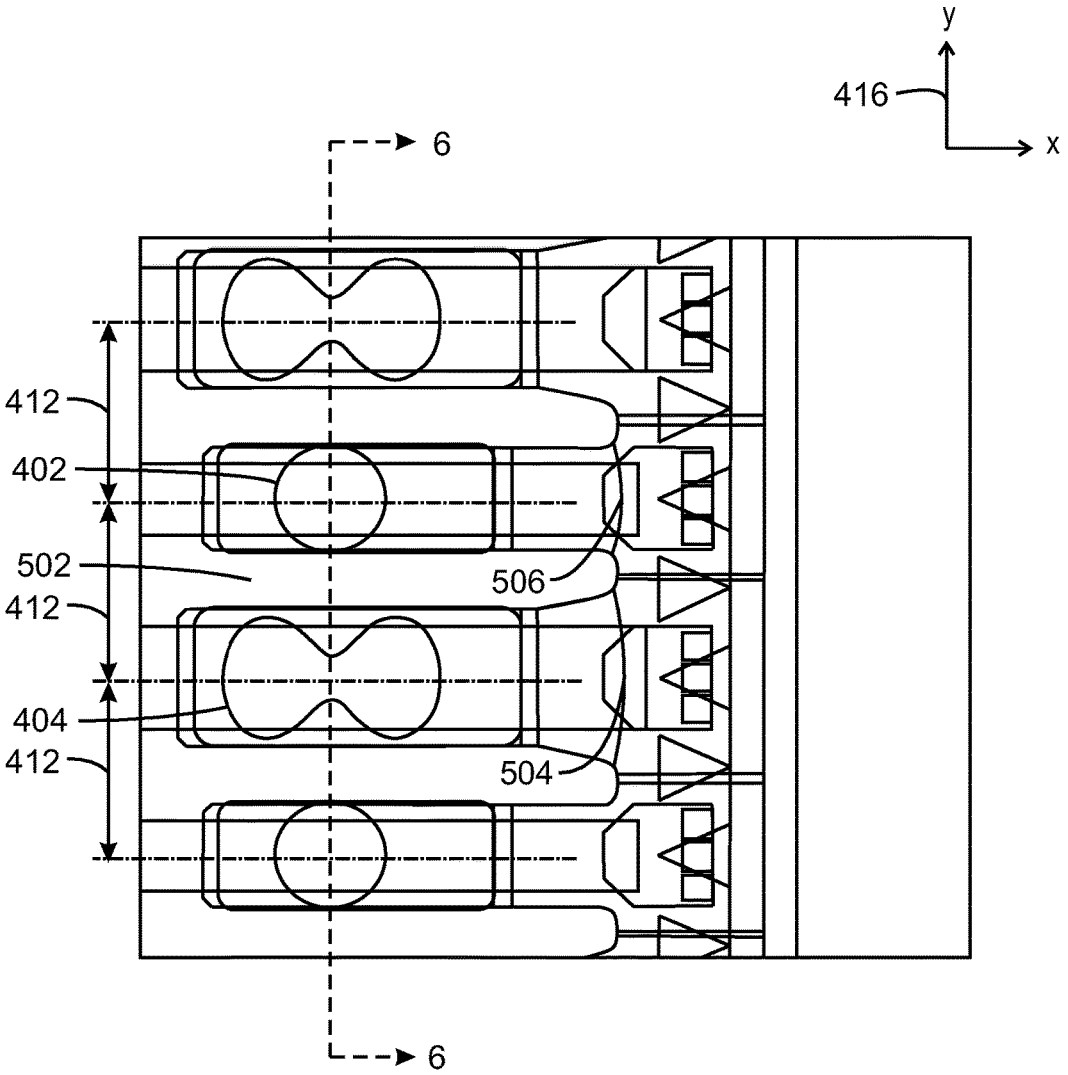
FIG. 5 is a close up top view of four of the drop generators.

FIG. 5 is a close up top view of four of the drop generators. Like numbered items are as described with respect to FIG. 4. In this example, the thickness of the epoxy sidewall 502 is a constant 5 um to assure sufficient structural strength. The HDW inflow region 504 is significantly larger, at about 20 μm, than the LDW inflow region 506, which is about 12 μm wide. By comparison, in a conventional design, each drop generator would be laid out to use the available 21.2 μm of space in the y-direction 416. Part of the space in the y-direction 416 would be needed at both ends to provide sufficient width to the epoxy walls that separate adjacent drop generators. This would leave a maximum inlet width of 21.2-5 or 16.2 μm. However, since the HDW drop generator needs additional flow while the LDW drop generator does not, the HDW inflow region 504 for the HDW drop generator can be expanded by a few microns and thus have increased flow.

Figure 6:
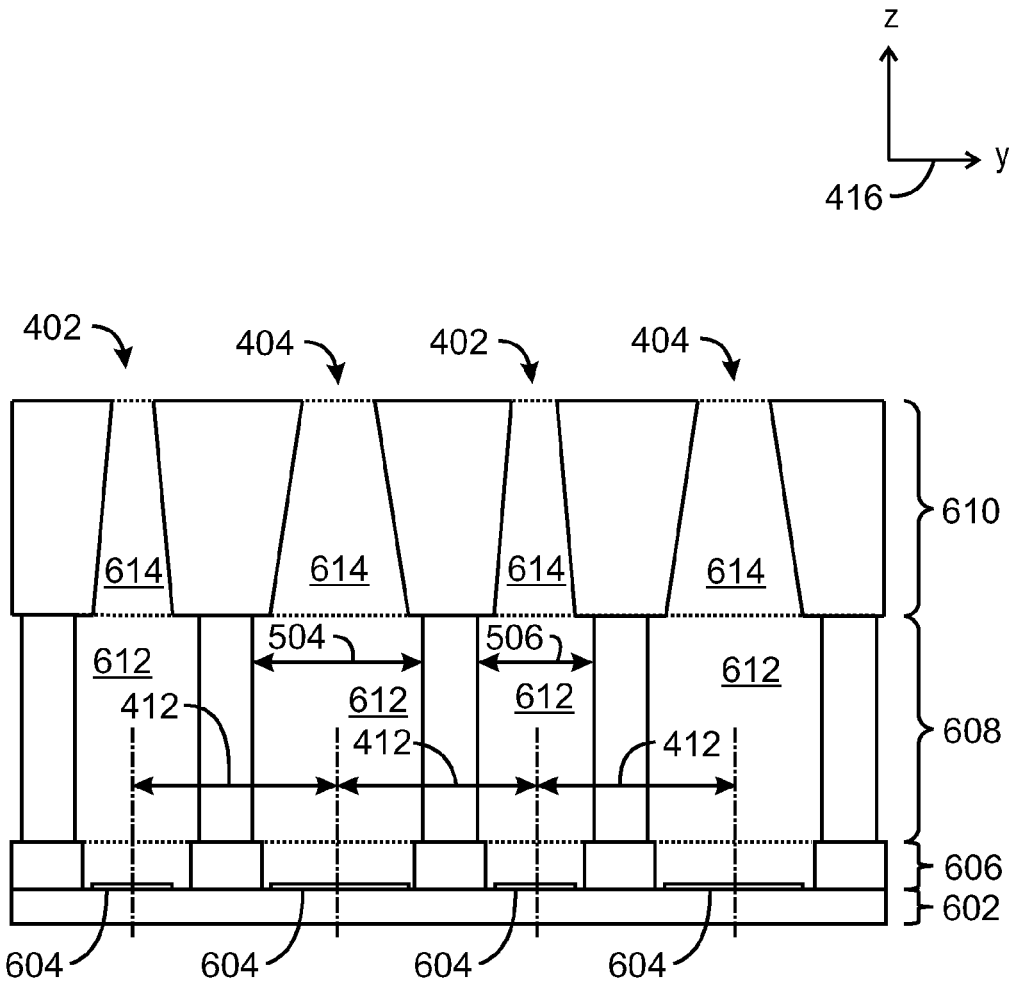
FIG. 6 is a cross sectional view of a printhead taken at a nozzle region, e.g., at line 6 in FIG. 5.

FIG. 6 is a cross sectional view of a printhead taken at a nozzle region, e.g., at line 6 in FIG. 5. Like numbered items are as discussed with respect to FIGS. 4 and 5. In this view, a resistor layer has been deposited on a starting wafer 602 and etched to form resistors 604 under each nozzle. Further layers can be formed to complete the printhead 800. A passivation film may be deposited over the resistors and traces to insulate the resistors and traces from materials in subsequent layers, such as an anticavitation film. The passivation film may be formed from dual stacked layers of SiC over SiN. Other dielectric materials that may be used include $Al_2O_3$ and $HfO_2$, among others. The anticavitation film, such a tantalum layer, may be deposited over the passivation film. The anticavitation film decreases erosion from cavitation, e.g., the formation and collapse of bubbles at the top surface of the resistor. As the passivation and anticavitation layers are essentially thin films, they are not shown in FIG. 9. A dielectric layer 902 may then be deposited over the wafer to enhance the adhesion of photocurable polymers used to form the rest of the fluidic structures.

A primer layer 606 may be deposited to enhance the adhesion of the subsequent layers 608 and 610. The layers 606, 608, and 610 may be formed from the same, or different, photocurable polymers, such as epoxy resins (including two monomers) or epoxy copolymer resins (including three or more monomers) containing a ultraviolet (UV) photoinitiator to cause crosslinking. The photocurable polymer is coated in a layer over the surface, and then a mask is used to shield areas that can be removed. Exposure to UV light cross-links the resin in locations not protected by the mask. After light exposure, the areas that were shielded by the mask, and are not cross-linked, can be removed from the surface, for example, using a solvent. In some examples, this may be reversed, e.g., with a positive photoresist, in which areas that are exposed to the light break down, and can be removed by an etchant. Generally, the primer layer 606 is not cured over the inflow regions and resistors of the drop generators.

After the primer layer 606 is cured, a second layer 608, such as another layer of photo-curable epoxy, can be deposited over the primer layer 608, masked, and exposed to allow the formation of walls. The uncured material in the second layer 608 can then be removed by solvent to reveal the flow channels and ejection chambers 612. In examples described herein, the width 504 of the flow channels and ejection chambers 612 of the HDW drop generators may be greater than the width 506 of the flow channels and chambers 612 of the LDW drop generators. This may allow the HDW drop generators to have a higher inflow of ink, and thus shorter refill time. Further, as described herein, the narrower width 506 of the LDW drop generators may decrease backflow into the ink reservoir, increasing the momentum of the drops. A third layer 610, such as another layer of epoxy, is then applied over the second layer 608 and masked to allow the creation of flow channel caps and nozzles 614. The design described provides dots on pitch for either LDW, HDW, or both while maintaining sufficient epoxy material for structural integrity and optimizing the flow for both a LDW and a HDW drop generator. Further control of the ink refill rates may be achieved by adjusting the amount of material left in the region of the drop generators, for example, by increasing or decreasing the amount of primer.

Figure 7A:
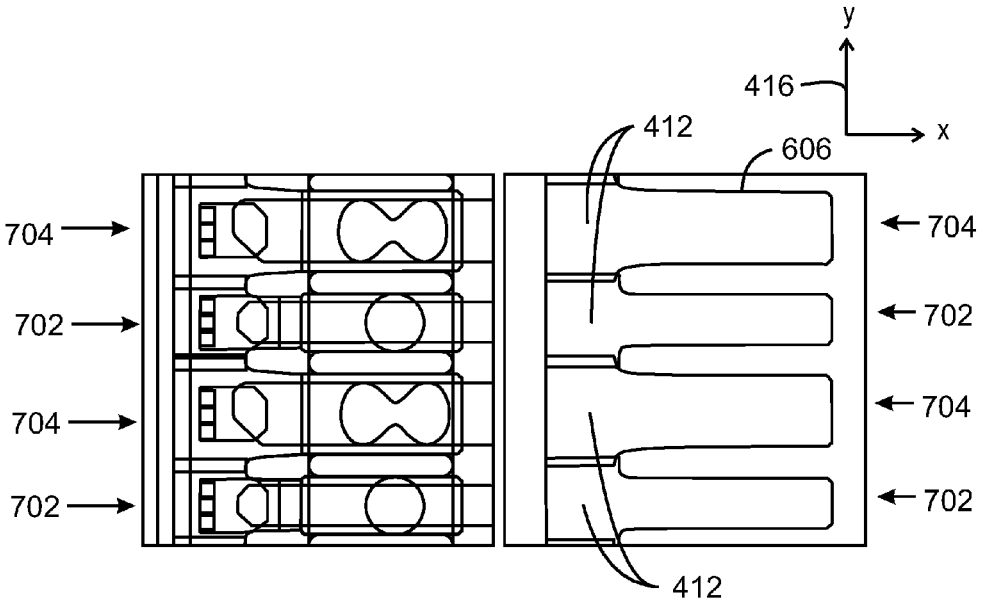
FIGS. 7A and 7B are top views of a wafer showing a design that modifies the amount of primer layer in the inflow region of the drop generators.
Figure 7B:
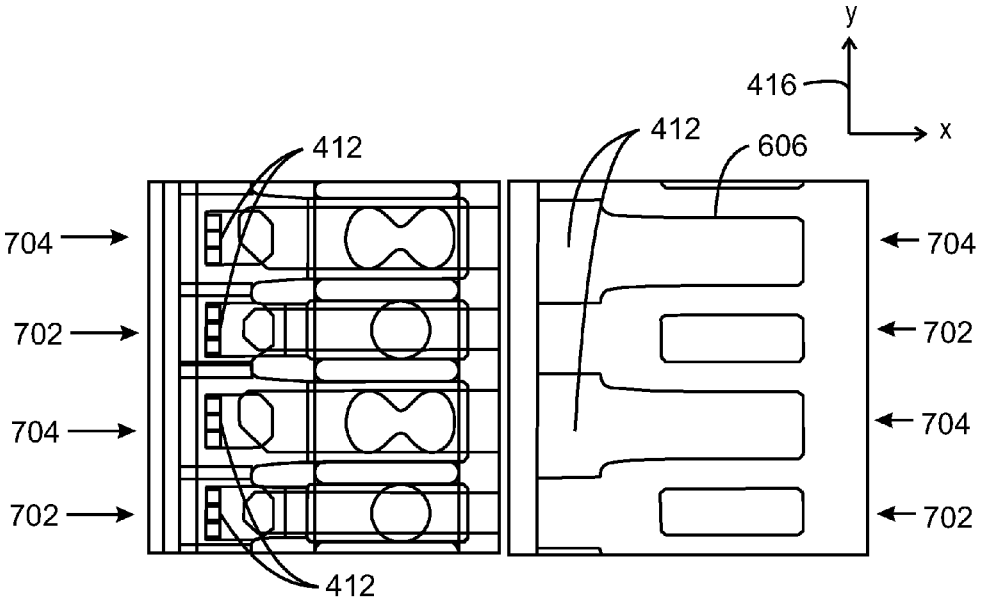

FIGS. 7A and 7B are top views of a wafer showing a design that modifies the amount of primer layer 606 in the inflow region 412 of the drop generators. Like numbered items are as described with respect to FIGS. 4 and 6. FIG. 7A shows a current arrangement, in which the primer layer 606 is removed, or decreased in thickness, underneath both the LDW drop generator 702 and the HDW drop generators 704. In contrast, FIG. 7B shows a design in which the HDW drop generator 704 has the primer layer 606 removed, but the LDW drop generator 702 has primer material 606 present in the inflow region 412. The presence of the primer material 606 in the inflow region 412 limits flow in or out, since the LDW drop generator 702 does not need the flow rate and will benefit from the increased momentum.

Figure 8:
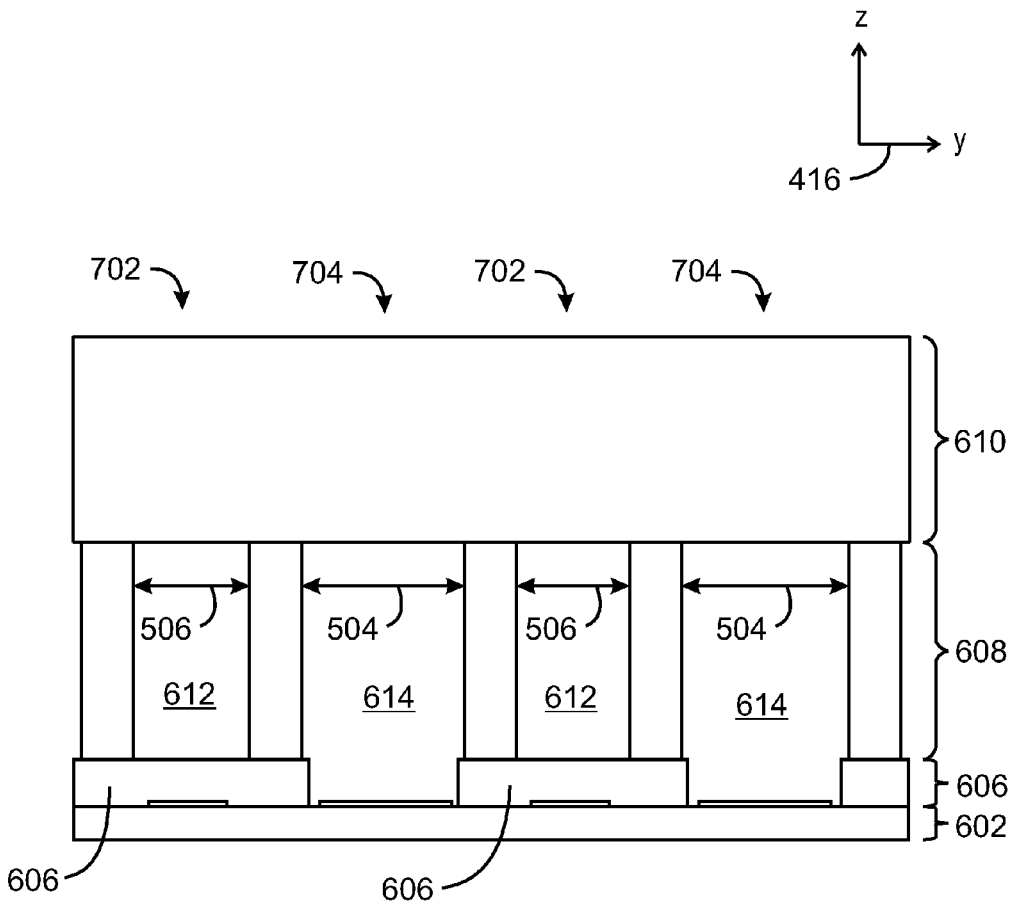
FIG. 8 is a cross-sectional view of the inflow region of the printhead section shown in FIG. 7B.

FIG. 8 is a cross-sectional view of the inflow region 412 of the printhead section shown in FIG. 7B. Like numbered items are as described with respect to FIGS. 4-7. This shows the smaller cross sectional area of the inflow region 412 for the LDW drop generators 702 resulting from the primer layer 606 that is crosslinked in the inflow regions of the LDW drop generators 702.

Figure 9:
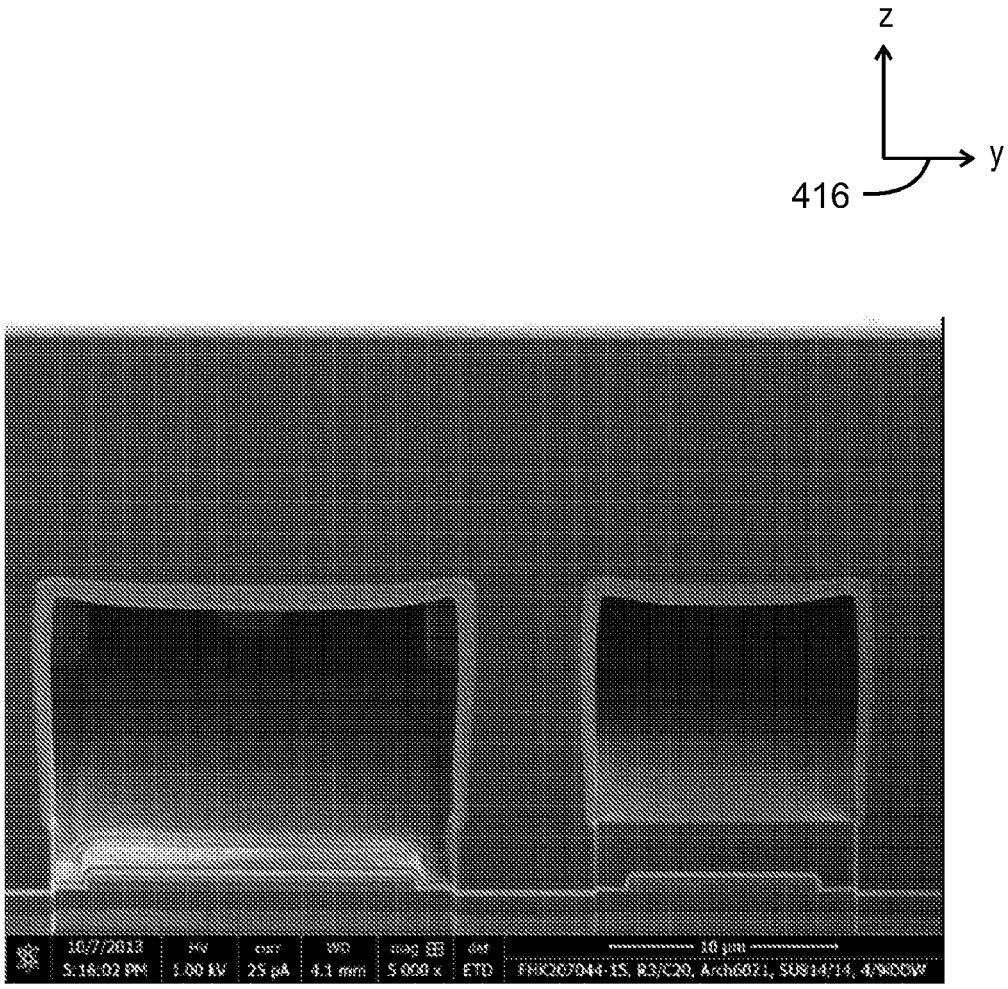
FIG. 9 is a scanning electron micrograph of the printhead of FIG. 8, taken at the inflow region.

FIG. 9 is a scanning electron micrograph of the printhead of FIG. 8, taken at the inflow region 412. As described herein, this leads to increased refill for the HDW drop generator and improved momentum for the LDW drop generator by changing the design of the primer mask.

Figure 10:
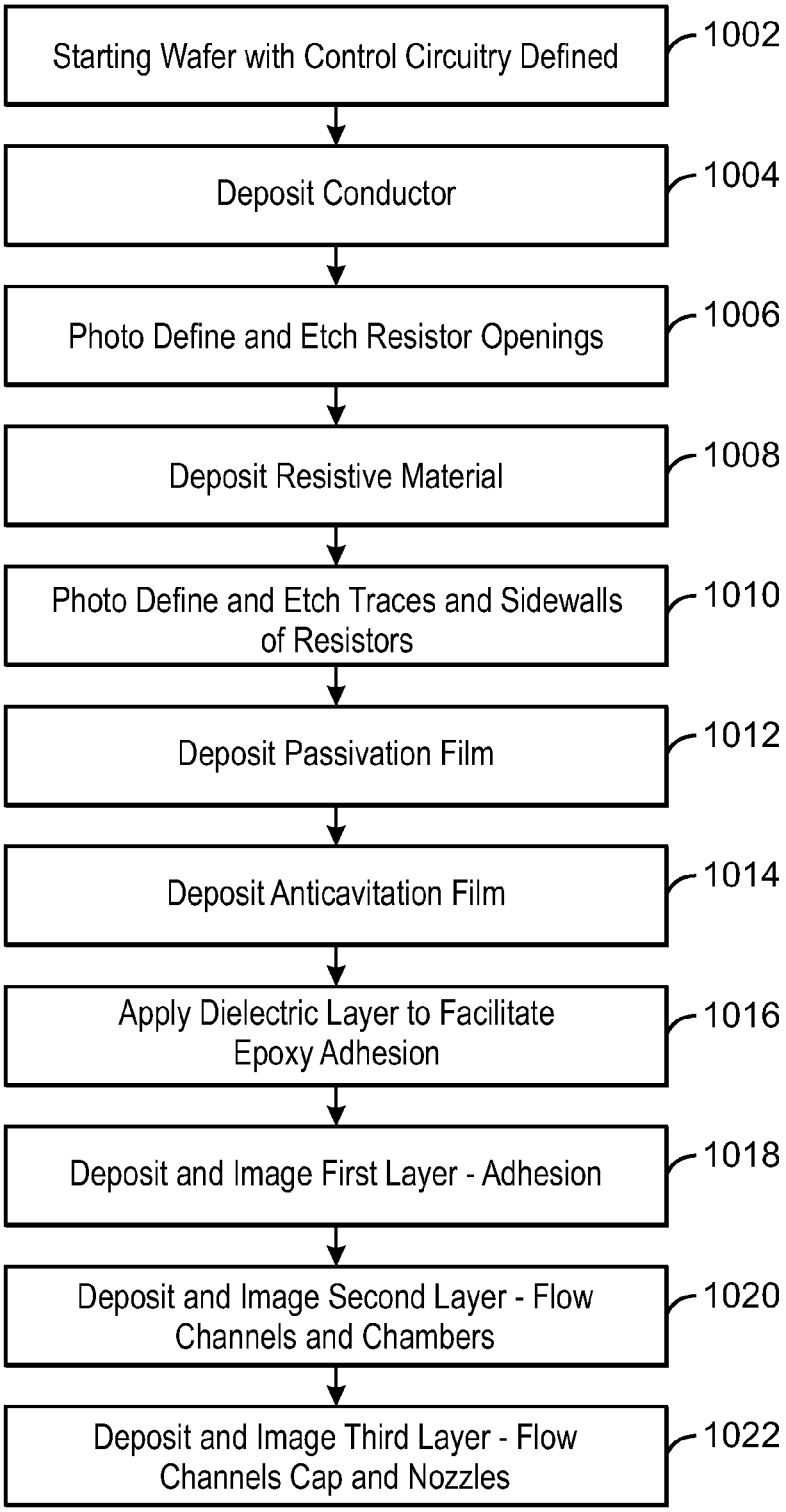
FIG. 10 is a process flow diagram of an example method 1000 to fabricate an ink jet printhead.

FIG. 10 is a process flow diagram of an example method 1000 to fabricate an ink jet printhead. The method 1000 begins at block 1002 with the fabrication of a starting wafer. The starting wafer is formed using techniques known in the art, and will typically have control electronics already defined, with vias through the top dielectric layer to which a conductor layer can bond.

A number of initial actions can be used to create the traces and resistors used to heat the ink for ejecting a drop at a surface. At block 1004, a conductor layer, such as aluminum, is deposited over the starting wafer. At block 1006, resistor openings are created, for example, by masking and etching the conductor layer. The resistor windows may be separate openings in the conductor layer over the areas of the resistors, or a single opening in the conductor layer that extends across the entire resistor area. At block 1008, a resistive material is deposited over the entire wafer, including the remaining conductor and the etched resistor windows. At block 1010, traces and resistors are defined by masking and etching the conductor and resistor layers in the desired pattern. In some examples described herein, the traces and resistors that are formed alternate between wider and narrower regions, to provide different drop sizes.

Further steps are used to protect the traces and resistors, and prepare the wafer for completion of the printhead. At block 1012, a passivation film is deposited over the traces and resistors, for example, to protect the traces and resistors from physical or chemical damage and to insulate them from subsequent layers. At block 1014, an anticavitation film is deposited over the passivation film, for example, to protect the resistors from cavitation. Cavitation is the rapid expansion and collapse, for example, at supersonic speeds, of bubbles, which can cause physical damage to a surface. At block 1016, a dielectric film may be deposited over the passivation film to enhance the adhesion of subsequent layers, such as an epoxy primer layer. In some examples, the dielectric layer may be omitted.

Once the surface is prepared, subsequent layers may be formed to complete the printhead. At block 1018, a first, or primer, layer is deposited to enhance adhesion of subsequent layers. The primer layer can be formed by crosslinking the primer in areas to each side of the droplet generators, and removed from the areas of the conductors and traces to avoid interfering with the flow of ink into the ejection chambers of the drop generators. However, in an example described herein, the primer may be crosslinked and left in an inflow region for the LDW drop generators, decreasing backflow from the LDW drop generators, and increasing momentum of a drop from the LDW.

At block 1020, a second layer is deposited, then masked and exposed to light to create flow channels and chambers, once any material that is not cross-linked is removed. In examples described herein, the inflow regions into the HDW generators may be increased in width at the expense of the inflow regions into the LDW drop generators. However, the wall thickness between adjacent drop generators is maintained at about 5 μm, or higher, to maintain the structural integrity of the drop generators.

At block 1022, a third layer is deposited over the flow channels and chambers. This layer may be masked and exposed to light to create nozzles and flow caps. The completed wafer can then be divided into segments and mounted to form the printhead.

The ink jet printheads described herein may be used in other applications besides two dimensional printing. For example, in three dimensional printing or digital titration, among others. In these examples, the different sizes of drop generators may be of benefit for other reasons. In digital titration, the HDW drop generator may be used to approach an end point quickly, while the LDW drop generator may be used to accurately determine the end point.

The present examples may be susceptible to various modifications and alternative forms and have been shown only for illustrative purposes. Furthermore, it is to be understood that the present techniques are not intended to be limited to the particular examples disclosed herein. Indeed, the scope of the appended claims is deemed to include all alternatives, modifications, and equivalents that are apparent to persons skilled in the art to which the disclosed subject matter pertains.

What is claimed is:

1. A printhead, comprising:

a plurality of drop generators, wherein a pitch between each adjacent drop generator is the same, and the plurality of drop generators alternates between a high drop weight (HDW) drop generator and a low drop weight (LDW) drop generator; and a flow channel from an ink source leading into an ejection chamber associated with each drop generator, wherein the flow channel comprises an inflow region for each drop generator, and wherein an inflow region for a HDW drop generator is wider than an inflow region for an adjacent LDW drop generator.

2. The printhead of claim 1, wherein a wall thickness between each ejection chamber is the same.

3. The printhead of claim 1, the flow channel being formed with a photoimageable epoxy.

4. The printhead of claim 1, further comprising a thicker primer layer in the inflow region of an LDW drop generator and a thinner primer layer in the inflow region of an adjacent HDW drop generator.

5. The printhead of claim 1, wherein, to maintain the same pitch between adjacent drop generators, space that would otherwise provide inflow for an LDW drop generator is used to provide additional space for inflow of an adjacent HDW drop generator.

6. The printhead of claim 1, wherein a reduced width of the inflow for an LDW drop generator is sufficient to decrease back pressure from bubble formation in the LDW drop generator.

7. A method for forming the printhead of claim 1, comprising:

depositing a conductor layer over a starting wafer, wherein the starting wafer comprises control electronics for the printhead;

etching a resistor window across the wafer;

depositing a resistor layer over the conductor layer and resistor window;

etching the resistor layer and conductor layer to form traces and resistors;

depositing a passivation film over the traces and resistors;

depositing an anticavitation film over the passivation film;

forming a primer layer over the passivation film;

designing flow structures to control the refill rate of a drop generator based, at least in part, on drop size forming the flow structures over the primer layer; and forming caps and nozzles over the flow structures.

8. The method of claim 7, comprising forming the flow structures using a photoimageable epoxy, and an exposure mask to form the structures.

9. The method of claim 8, comprising forming wider resistors in an alternating pattern with narrower resistors, wherein the pitch between each resistor is held constant.

10. The method of claim 7, wherein designing the flow structures comprises disposing alternating a plurality of high drop weight (HDW) drop generators with a plurality of low drop weight (LDW) drop generators, wherein:

a pitch between each drop generator is the same;

a larger inflow region is provided for each HDW drop generator than for each LDW drop generator; and a wall thickness between an ejection chamber of each HDW drop generator and an ejection chamber for each adjacent LDW drop generator is the same.

11. The method of claim 10, comprising forming a wall channel between an ejection chamber for each HDW drop generator and an adjacent ejection chamber for an LDW drop generator that is at least about 5 micrometers wide.

12. The method of claim 10, comprising forming an inflow region for the HDW drop generator that is greater than about 18 micrometers wide.

13. The method of claim 10, comprising forming an inflow region for the LDW drop generator that is less than about 12 micrometers wide.

14. The method of claim 7, comprising decreasing the depth of the primer region in an inflow region of a HDW drop generator.

15. The method of claim 7, comprising increasing the depth of the primer layer in an inflow region of a LDW drop generator.

16. A printhead, comprising:

a plurality of drop generators, wherein a pitch between each adjacent drop generator is the same, and the plurality of drop generators alternates between a high drop weight (HDW) drop generator and a low drop weight (LDW) drop generator; and a flow channel from an ink source leading into an ejection chamber associated with each drop generator, wherein the flow channel comprises an inflow region for each drop generator, and further comprising a thicker primer layer in the inflow region of an LDW drop generator and a thinner primer layer in the inflow region of an adjacent HDW drop generator.

17. The printhead of claim 16, comprising an inflow region for a HDW drop generator that is proportionally wider than an inflow region for an adjacent LDW drop generator.

18. A printer comprising a printbar, wherein the printbar comprises a printhead that comprises:

a plurality of drop generators, wherein a pitch between each adjacent drop generator is the same, and the plurality of drop generators alternates between a high drop weight (HDW) drop generator and a low drop weight (LDW) drop generator; and a flow channel from an ink source leading into an ejection chamber associated with each drop generator, wherein the flow channel comprises an inflow region for each drop generator, and wherein an inflow region for a HDW drop generator is wider than an inflow region for an adjacent LDW drop generator.

19. The printer of claim 18, further comprising a thicker primer layer in the inflow region of an LDW drop generator and a thinner primer layer in the inflow region of an adjacent HDW drop generator.

20. The printer of claim 18, wherein a wall thickness between each ejection chamber is the same.

* * * * *